US007607297B2

(12) United States Patent
Moya

(10) Patent No.: US 7,607,297 B2
(45) Date of Patent: Oct. 27, 2009

(54) TOTAL POWER CONTROLLER

(75) Inventor: Juan Moya, Horb (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 342 days.

(21) Appl. No.: 10/583,070

(22) PCT Filed: Nov. 11, 2004

(86) PCT No.: PCT/EP2004/012808

§ 371 (c)(1),
(2), (4) Date: Oct. 18, 2006

(87) PCT Pub. No.: WO2005/057011

PCT Pub. Date: Jun. 23, 2005

(65) Prior Publication Data

US 2007/0151236 A1 Jul. 5, 2007

(30) Foreign Application Priority Data

Dec. 15, 2003 (DE) ..... 103 58 727

(51) Int. Cl.
*F16D 31/02* (2006.01)

(52) U.S. Cl. ..... 60/452

(58) Field of Classification Search ..... 60/452
See application file for complete search history.

(56) References Cited

U.S. PATENT DOCUMENTS 4,880,359 A * 11/1989 Hoffmeister et al. ..... 60/421
5,333,997 A * 8/1994 Hormann et al. ..... 60/428
5,567,123 A * 10/1996 Childress et al. ..... 417/222.1
5,974,796 A * 11/1999 Ishikawa et al. ..... 60/452
6,183,210 B1 * 2/2001 Nakamura ..... 60/431

FOREIGN PATENT DOCUMENTS

| | | | |
|---|---|---|---|
| DE | 39 19175 | A1 | 12/1990 |
| DE | 0 561 153 | A1 | 9/1993 |
| EP | 0 761 966 | A2 | 7/1996 |
| EP | 0 945 619 | A1 | 9/1998 |

OTHER PUBLICATIONS

Abstract of Japanese Publication No. JP 10141241, dated May 26, 1998.
Abstract of Japanese Publication No. JP 2001-1254681, dated Sep. 21, 2001.

* cited by examiner

*Primary Examiner*—F. Daniel Lopez
(74) *Attorney, Agent, or Firm*—Scully, Scott, Murphy & Presser, P.C.

(57) ABSTRACT

The invention relates to a total power regulation device for two pumps (2, 42), each of which is connected to a working conduit (5, 45). The delivery volume of the pumps (2, 42) can be set separately by a respective adjusting device (6, 46), whereby a control pressure that is active in each adjusting device (6, 46) can be set by a total power regulation valve (18, 58). The latter (18, 58) has a measuring surface (24, 64) of the total power regulation valve (18, 58) of one pump (2, 42) can be directly exposed to the working pressure of the other pump (42, 2).

4 Claims, 2 Drawing Sheets

TOTAL POWER CONTROLLER

Figure 1:
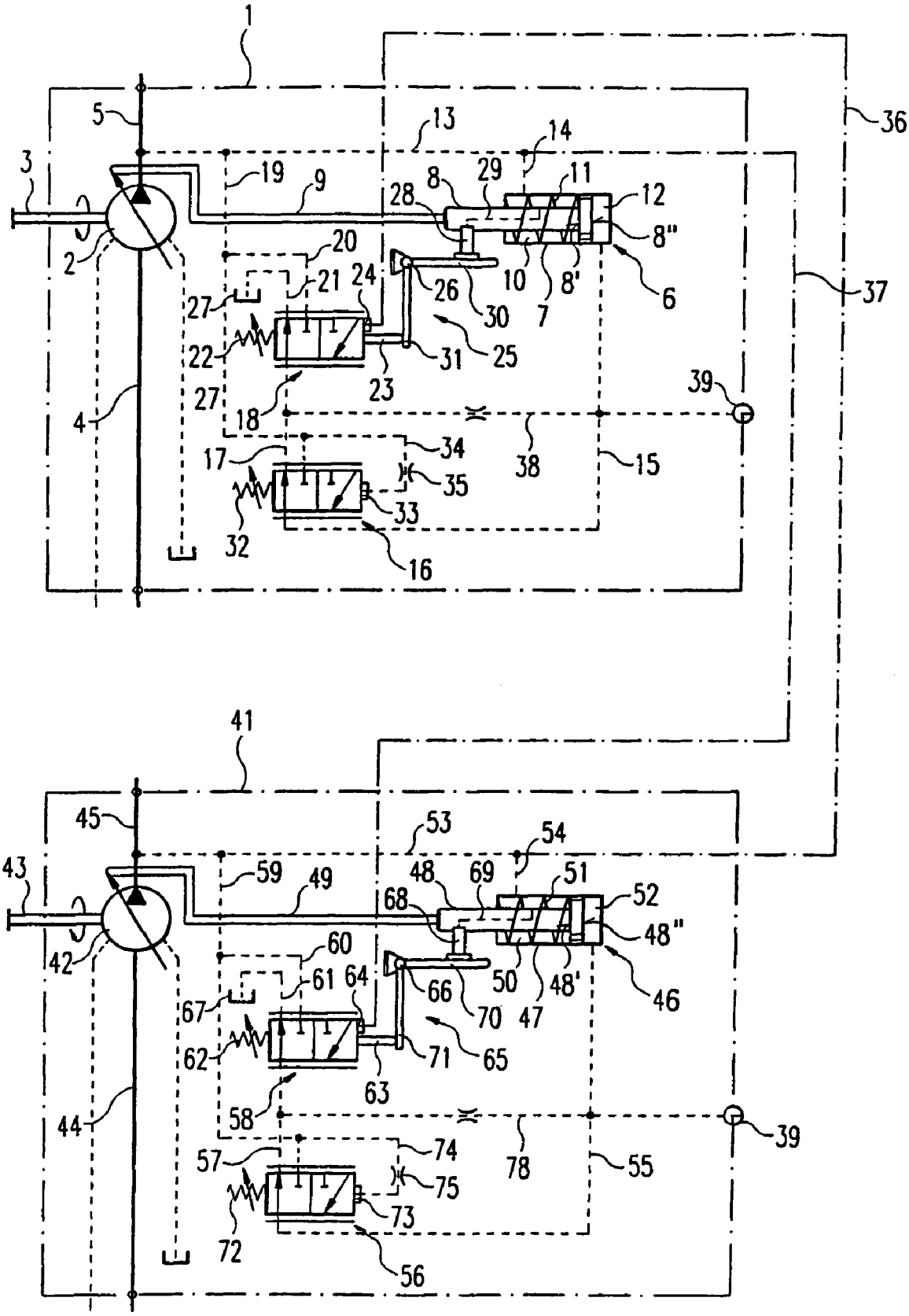

The invention concerns a total power controller for two pumps.

In the design of hydraulic systems, it is often advantageous to provide a single primary drive source to drive multiple hydraulic pumps which convey in separate circuits. One difficulty is exploiting the power of the primary drive source as efficiently as possible. To achieve good exploitation of the available drive power, the power controls of the two hydraulic pumps are linked by information about the power which is absorbed by one hydraulic pump being fed in the form of a pressure to the power control of the other hydraulic pump.

Thus, from EP 0 561 153 B1, providing a power controller, in which a so-called hyperbolic controller is used, for each of a first and second pump is known. By using such a hyperbolic controller, the power hyperbola is simulated. For this purpose, a reversing lever, on one leg of which the pressure which is generated by the hydraulic pump in the pressure-side working conduit is applied, is used, the application point of this force, which is proportional to the pressure, depending on the set conveyed volume of the hydraulic pump.

The second leg of the reversing lever acts on a power control valve, by which an adjusting pressure, which acts on an adjusting piston connected to an adjusting mechanism of the pump, is set. Now, to limit the power which the hydraulic pump can absorb and thus make it available to the other pump, a counter-force depending on the working pressure of the second hydraulic pump is generated on the first leg of the reversing lever.

The counter-force falls with increasing pressure generated by the second hydraulic pump. To generate such a counter-force, a cylinder with a piston arranged in it is used. An adjustable spring acts on the said piston in the direction of the first leg of the reversing lever. The piston which is guided in the cylinder has a piston surface which is acted on by the working pressure of the second hydraulic pump. The hydraulic force, which increases with the working pressure, acts against the force of the adjustable spring, and the counter-force which acts on the leg of the reversing lever is reduced.

The second hydraulic pump is of completely identical construction to the first hydraulic pump described above, wherein, in the same way, a cylinder with a piston arranged in it to adjust the counter-force which acts on the reversing lever of the second hydraulic pump is provided. Corresponding to the first hydraulic pump, to generate the counter-force for the second hydraulic pump, the working pressure of the first hydraulic pump now acts on the piston surface of the piston.

The described controller to control the total power has the disadvantage that a cylinder which has a piston arranged in it, and also acts on the reversing lever, must be provided for each of the two hydraulic pumps. To achieve a symmetrical adjustment, the compression spring which acts on each piston must be precisely adjusted.

Retrofitting total power control onto separate power control or vice versa is also associated with considerable cost.

A further disadvantage is the space which the cylinder to generate the counter-force requires. This counteracts, in particular, the effort to create as simple and compact a system as possible, a primary drive source being provided to drive two hydraulic pumps.

The invention is therefore based on the object of creating a total power controller which takes account of the power which is absorbed by the other pump in the power control, without requiring additional components compared with separate power control.

The object is achieved by a total power controller according to the invention, with the features of claim 1.

In the case of the total power controller according to the invention, the conveyed volume of two pumps can be adjusted separately. The conveyed volume is changed by an adjusting device which is connected in each case to one of the pumps, and adjusts the volume flow which is conveyed in each case in a working conduit. To activate the adjusting device, an adjusting pressure which can be adjusted by a total power control valve acts in the adjusting device. A total power control valve, in which a measuring surface is arranged, is associated with each adjusting device. The working pressure, which is conveyed by the other pump in the working conduit connected to it, acts on the said measuring surface. Via this measuring surface of the total power control valve, which is provided to adjust the conveyed volume of a pump, the working pressure, which the other pump generates, is taken into account when adjusting the adjusting pressure. In this way, the working pressure of the other pump is used to decide the power which the second pump absorbs.

By the steps which are listed in the sub-claims, advantageous extensions of the total power controller according to the invention are implemented.

In particular, it is advantageous that the total power control valves of the hydraulic pumps are implemented as valve cartridges. In this way, simple conversion from a pump with a conventional power control valve to total power control is possible by exchanging the different valve cartridges.

According to another preferred embodiment, the measuring surface on the valve piston of the valve cartridge is implemented as a ring surface. Implementation of the measuring surface as a ring surface makes it possible to use the remaining free area of the face of the valve piston to introduce further force, for instance through a reversing lever in the case of a hyperbolic controller.

Another advantage is that the measuring surface is arranged between two pressure-free areas in the axial direction. In this way the small but unavoidable leakage flow which occurs when the working pressure of the other hydraulic pump is applied to the ring surface can easily be carried away. This is preferably achieved by a volume which is connected to a tank inlet being provided adjacent to the space in which the ring surface is arranged.

Preferably, on the other side, adjacent to the space in which the ring surface is arranged, a spring space, the volume of which is likewise connected to the tank volume, is provided. In this spring space, at least one compression spring is arranged, and applies to the valve piston, axially, a force against which the valve piston is acted on by both the working pressure of the other hydraulic pump and the force which is proportional to the power of the hydraulic pump to be adjusted. For this purpose, the force proportional to the power acts on the end of the valve piston facing away from the spring space.

A preferred embodiment of the total power controller according to the invention is shown in the drawings and explained in more detail on the basis of the following description.

Figure 2:
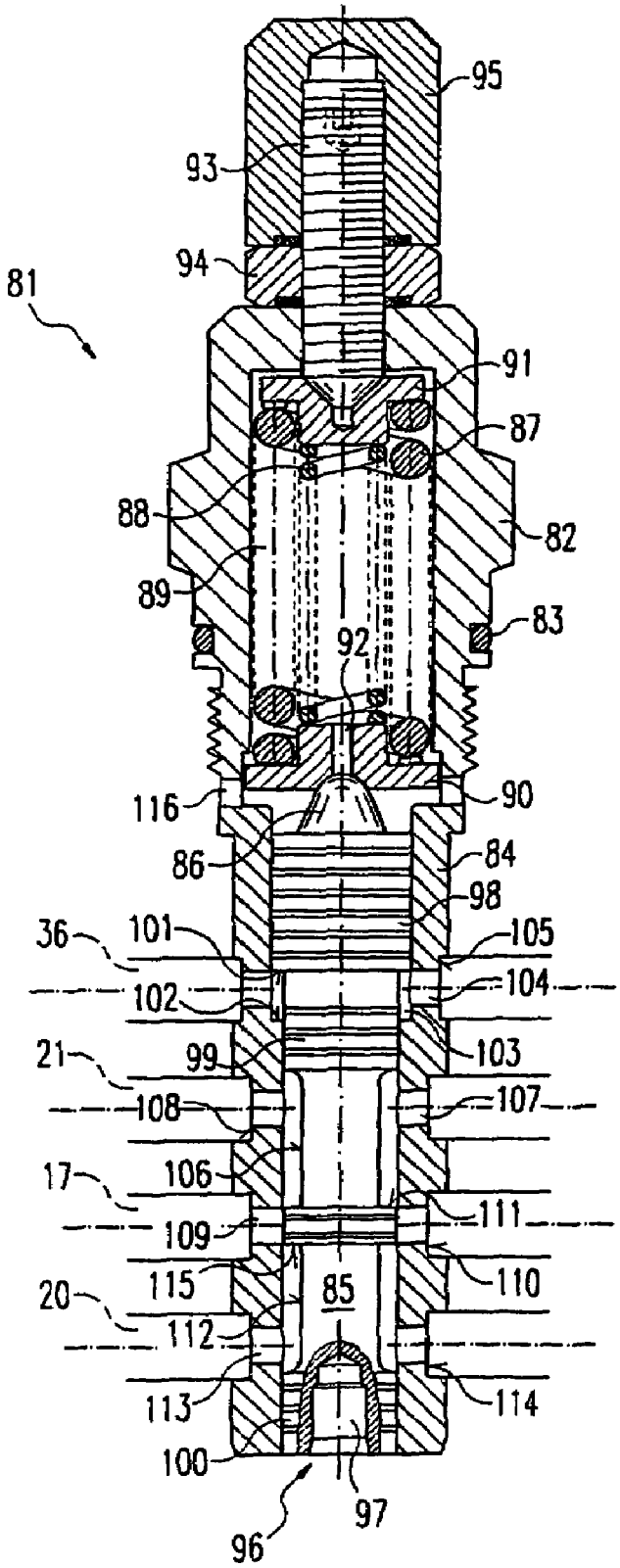

FIG. 1 shows a hydraulic circuit diagram of a total power controller according to the invention; and FIG. 2 shows a cross-section of a valve cartridge of a total power control valve of the total power controller according to the invention.

In FIG. 1, the total power controller according to the invention for a first hydraulic pump unit 1 and a second hydraulic pump unit 41 (shown in the lower part of FIG. 1) is shown. The first hydraulic pump unit 1 and second hydraulic pump unit 41 are comparable regarding their construction, for which reason the individual elements and their function are described in detail on the basis of the first hydraulic pump unit 1 only.

The first hydraulic pump unit 1 has a pump 2, which is driven via a drive shaft 3 by a prime mover (not shown). Such a prime mover can be, for instance, a diesel motor or an electric motor. The pump 2 is provided to convey in a first hydraulic circuit, and for this purpose sucks pressurising medium via a suction conduit 4 and conveys it into a working conduit 5. The pump 2 which is provided in the shown example is designed to convey in one direction only, since the embodiment involves an open circuit. However, the invention can also be used with closed circuits.

To adjust the volume which is conveyed into the working conduit 5, the conveyed volume of the pump 2 is adjustable by an adjusting device 6, which includes a cylinder 7, in which an adjusting piston 8 is arranged so that it can be moved longitudinally. This adjusting piston 8 is connected via a linkage 9 to the pump 2, to adjust its conveyed volume.

The adjusting piston 8 has a first piston surface 8' and a second piston surface 8", which are oriented oppositely to each other and to which a force can be applied in a working pressure chamber 10 and adjusting pressure chamber 12 respectively. The first piston surface 8' is smaller than the second piston surface 8", wherein the hydraulic force which acts on the first piston surface 8' is supported by a spring 11, which applies a force to the adjusting piston 8 in the direction of the adjusting pressure chamber 12. A movement of the adjusting piston 8 in the direction of the adjusting pressure chamber 12 causes an adjustment of the pump 2 in the direction of its maximum conveyed volume.

When the pump 2 starts up, the working pressure chamber 10 and adjusting pressure chamber 12 are pressure-free, so that the spring 11 brings the adjusting piston 8 into its final position (FIG. 1, right), and thus the pump 2 is adjusted to maximum conveyed volume.

On the other hand, if the pump 2 conveys the pressurising medium into the working conduit 5, this pressure, which is generated in the working conduit 5, prevails in the working pressure chamber 10. For this purpose, the working conduit 5 is connected via a working pressure feed conduit 13 and a first branch 14 which branches off it to the working pressure chamber 10. Thus in the working pressure chamber 10, in addition to the force of the spring 11, a pressure which is proportional to the working pressure which prevails in the working conduit 5 always acts on the adjusting piston 8. This working pressure acts on the first piston surface 8' of the adjusting piston 8, and also applies the force of the spring 11 to it, so that the pump 2 is adjusted in the direction of its maximum conveyed volume.

To limit this adjusting movement, a defined adjusting pressure is set in the adjusting pressure chamber 12. If an equilibrium between the forces acting on the adjusting piston 8 in the working pressure chamber 10 and adjusting pressure chamber 12 is thus set, the conveyed volume of the pump 2 is not further adjusted. To adjust the adjusting pressure in the adjusting pressure chamber 12, the adjusting pressure chamber 12 is connected via an adjusting pressure channel 15, a pressure control valve 16 and a connecting channel 17 to a total power control valve 18. The connecting channel 17 connects the total power control valve 18 to the pressure control valve 16, which in its idle position represents an unthrottled connection between the connecting channel 17 and the adjusting pressure conduit 15.

The total power control valve 18 is a 3/2-way valve, which is connected on the input side to a joining channel 20 and a tank channel 21. The joining channel 20 feeds the working pressure which prevails in the working conduit 5 to the total power control valve 18. For this purpose, the joining channel 20 is connected to a second branch 19, which in turn is connected to the first working pressure feed conduit 13.

The position of the total power control valve 18 is determined by an adjustable compression spring 22 and the forces which act against the adjustable compression spring 22 onto a tappet 23 and measuring surface 24. The pressure which is generated in the working conduit of the second hydraulic pump unit 41 acts on the measuring surface 24, and generates a hydraulic force. On the other hand, a force which is proportional to the absorbed power of the pump 2 acts on the tappet 23 via a reversing lever 25, which is supported so that it can rotate around a centre of rotation 26.

In its idle position, i.e. when the second hydraulic pump unit 41 generates no working pressure and the first hydraulic pump unit 1 also absorbs no power, the total power control valve 18 is held in its first final position (shown in FIG. 1) by the adjustable compression spring 22. In the first final position of the total power control valve 18, the connecting channel 17 is connected via the tank channel 21 to a tank volume 27. Thus by the total power control valve 18, the adjusting pressure chamber 12 is relieved into the tank volume 27 via the adjusting pressure channel 15, the open pressure control valve 16 and the connecting channel 17, and finally via the tank channel 21. The falling adjusting pressure in the adjusting pressure chamber 12 results in a movement of the adjusting piston 8 in FIG. 1 to the right, because of the unchanged pressure which prevails at first in the working pressure chamber 10. Thus the pump 2 is adjusted via the linkage 9 in the direction of greater conveyed volume.

During operation of the first hydraulic pump unit 1, such an adjustment of the adjusting piston 8 has the consequence that the application point of a piston 28 on a first leg 30 of the reversing lever 25 is shifted. An adjustment of the conveyed volume of the pump 2 causes a shift of the application point of the piston 28, so that the gap between the application point and the centre of rotation 26 is magnified. The piston 28 is connected via an internal channel 29, which is formed in the adjusting piston 8, to the working pressure chamber 10. Thus the piston 28 presses on the first leg 30 of the reversing lever 25, a torque which is proportional to the absorbed power of the pump 2 being generated on the reversing lever 25 by the gap, which depends on the set conveyed volume, between the centre of rotation 26 and the application point of this force, which is proportional to the working pressure.

Thus a force, which is proportional to the power absorbed by the pump 2, acts on the tappet 23, against the force of the adjustable compression spring 22. If this force increases, e.g. because of a pressure increase in the working conduit 5, the result is an adjustment of the total power control valve 18 in the direction of its second final position, in which the joining channel 20 is connected to the connecting channel 17. This means that with increasing connection of the joining channel 20 to the connecting channel 17, the pressure of the working conduit 5 is increasingly applied to the adjusting pressure chamber 12, to increase the adjusting pressure.

Because of this increasing adjusting pressure in the adjusting pressure chamber 12, the adjusting piston 8 is moved to the left in FIG. 1 against the working pressure which prevails in the working pressure chamber 10 and the force of the spring 11, i.e. the pump 2 is adjusted in the direction of smaller conveyed volume. Simultaneously with this adjustment of the pump 2 in the direction of smaller conveyed volume, the gap between the application point of the piston 28 and the centre of rotation 26 is reduced, so that the force which acts on the tappet 23 is reduced. The adjustment takes place until, for instance, an increased pressure in the working conduit 5 is compensated for by a corresponding reduction of the conveyed volume of the pump 2, so that the absorbed power of the pump 2 remains constant.

The adjustment of the conveyed volume of the pump 2 follows the hyperbolic course of the power characteristic curve. In the direction of greater working pressures, this characteristic curve approaches a corresponding minimum conveyed volume asymptotically. However, this is associated with a large pressure increase. To prevent this, and thus to ensure that a permitted maximum pressure is not exceeded in the conduit system, above this maximum pressure, pressure is applied to the adjusting pressure chamber 12 by the pressure control valve 16, and thus the pump 2 is adjusted in the direction of smaller conveyed volume. In this case, the power control is overridden by the pressure control valve 16.

As explained above, in the normal case and thus in the idle position of the pressure control valve 16, the connecting channel 17 is connected unthrottled to the adjusting pressure channel 15. The pressure limiting valve 16 is held in this position by another adjustable compression spring 32. To bring the pressure control valve 16 into its second final position, in which the second branch 19 is connected to the adjusting pressure channel 15, the pressure which prevails in the working conduit 5 is applied to a conveyed pressure measuring surface 33. The conveyed pressure measuring surface 33 is oriented so that the hydraulic force which acts on the pressure control valve 16 or its valve piston is directed against the force of the other adjustable compression spring 32.

If the pressure in the working conduit 5 exceeds a certain pressure limit, the pressure control valve 16 is thus adjusted in the direction of its second end position against the force of the adjustable pressure spring 32, which consequently determines this pressure limit, and the working pressure which prevails in the working conduit 5 is applied to the adjusting pressure chamber 12. Consequently, the adjusting piston is shifted to the left in FIG. 1, and the pump 2 is adjusted in the direction of smaller conveyed volume. To connect the conveyed pressure measuring surface 33 to the second branch 19, a measuring channel 34, in which a throttle 35 is arranged, is provided.

Additionally, a throttled connection 38, which connects the connecting channel 17 to the adjusting pressure channel 15 bypassing the pressure control valve 16, is provided. To be able to monitor the currently set adjusting pressure, preferably the throttled connection 38 is taken out of the housing of the first hydraulic pump unit 1 and can be tapped at a measuring outlet 39.

If a second hydraulic pump unit 41 is driven by the same prime mover as the first hydraulic pump unit 1, when the power of the first hydraulic pump unit 1 is adjusted the power which is absorbed by the second hydraulic pump unit 41 must be taken into account. This is done via the measuring surface 24, which is formed on the total power control valve 18. A pressure is applied to the measuring surface 24, which thus generates a hydraulic force, which acts in the same direction as the force which acts on the tappet 23, against the force of the adjustable compression spring 22.

To feed to the measuring surface 24 a magnitude which characterizes the power, which the second hydraulic pump unit 41 absorbs, the measuring surface 24 is connected via a first connecting conduit 36 to the second hydraulic pump unit 41. The corresponding elements of the second hydraulic pump unit 41 have reference symbols which are each increased by 40 compared with the reference symbol of the corresponding element of the first hydraulic pump unit 1.

At the end of the first connecting conduit 36 facing away from the measuring surface 24 of the first hydraulic pump unit 1, the first connecting conduit 36 is connected to the working pressure conduit 53 of the second hydraulic pump unit 41. Thus the working pressure which is generated in the working conduit 45 of the second hydraulic pump unit 41 by the pump 42 of the second hydraulic pump unit 41 is fed via the working pressure feed conduit 53 of the second hydraulic pump unit 41 and the first connecting conduit 36 to the measuring surface 24 of the total power control valve 18 of the first hydraulic pump unit 1.

This additional force on the total power control valve 18 of the first hydraulic pump unit 1 causes a greater adjustment of the pump 2 of the first hydraulic pump unit 1 in the direction of a smaller conveyed volume. Thus the total available driving power of the prime mover (not shown) is distributed in mutual dependency to the first hydraulic pump unit 1 and second hydraulic pump unit 41. The two hydraulic pump units 1 and 41 are driven by the prime mover via the appropriate drive shaft 3 and 43 respectively, either directly or via a power divider (also not shown).

Corresponding to the analogous construction of the first hydraulic pump unit 1 and second hydraulic pump unit 41, a second connecting conduit 37, through which the working pressure which prevails in the working conduit 5 and thus the working pressure feed conduit 13 of the first hydraulic pump unit 1 is fed to the measuring surface 64 of the total power control valve 58 of the second hydraulic pump unit 41, is provided. Thus in reverse, the power which is absorbed by the first hydraulic pump unit 1 is taken into account in adjusting the adjusting pressure for the adjusting device 46 of the second hydraulic pump unit 41.

To produce compact hydraulic pump units, it is advantageous to insert the total power control valves 18 and 58 as so-called valve cartridges into the housings of the hydraulic pump units. In FIG. 1, the housings are shown schematically by the dot-dash lines which surround all the elements within the housings, and are identified by the reference symbol 1. As well as the total power control valves 18 and 58, the pressure control valves 16 and 56 are preferably implemented as valve cartridges, and are inserted into a corresponding bore in the housing of the appropriate hydraulic pump unit 1 or 41 respectively.

A preferred embodiment of such a valve cartridge 81 of a total power control valve 18 and 58 of the total power controller according to the invention is shown in FIG. 2.

The valve cartridge 81 is inserted into an opening, which is provided for the, purpose, of the housing of the first hydraulic pump unit 1 and second hydraulic pump unit 41. To fix the valve cartridge 81, a thread is provided on a valve housing 82, is screwed into a corresponding thread of the housing of the hydraulic pump unit, and is sealed by means of a gasket 83. On the side of the valve housing 82 which extends into the housing of the hydraulic pump unit, a valve sleeve 84 is joined in the axial direction.

The valve sleeve 84 is penetrated axially by a stepped recess, into which a valve piston 85 is inserted. This valve piston 85 has at one end an extension 86, which extends slightly out of the valve sleeve 84 in the direction of the valve housing 82. The valve housing 82 also has a central recess in the form of a blind hole, into which a first spring 87 and a second spring 88 are inserted. The first spring 87 and second spring 88 are implemented as compression springs, and are accommodated by the central recess, which forms a spring space 89, of the valve housing 82.

The first and second springs 87 and 88 are each supported on a first spring seat 90 and second spring seat 91. The first spring seat 90 has in the middle a centring, which extends in the axial direction and is penetrated by a longitudinal bore 92, for the first and second springs 87 and 88. The first spring seat 90 has a substantially disc-shaped geometry, which on the side facing away from the centring has an indentation into which the extension 86 of the valve piston 85 engages, so that pressure forces can be transmitted in the axial direction between the valve piston 85 and the first spring seat 90.

At the opposite end of the spring space 89, the second spring seat 91, which has on one side an indentation and on the side opposite the indentation a centring to centre the first spring 87 and second spring 88, is arranged. One end of an adjusting screw 93 engages into the indentation of the second spring seat 91. The adjusting screw 93 is screwed into a thread which is arranged in the valve housing 82, so that by screwing in the adjusting screw 93 further, the gap between the first spring seat 90 and second spring seat 91 can be reduced. Thus by turning the adjusting screw 93, the tension of the first spring 87 and second spring 88 can be changed, and thus the characteristic curve of the total power control valve 18 or 58 can be adjusted. To prevent unintentional turning of the adjusting screw 93, the adjusting screw 93 is fixed against the valve housing 82 by a locknut 94. Another form of protection is to screw on a thread cap 95, which prevents contamination or corrosion of the adjusting screw 93.

The extension 86 is arranged on the face of one end of the valve piston 85 and is approximately dome-shaped. On the other hand, on the opposite face 96 of the valve piston 85, a recess 97 is arranged. The purpose of this recess 97 is to receive the tappet 23 which is known from FIG. 1, and it can also have an internal thread to fix said tappet.

Starting from the extension 86, the valve piston 85 has a first guide section 98, axially at a distance from it a second guide section 99, and again at a greater axial distance from the latter a third guide section 100. This third guide section 100 is arranged axially in the area of the recess 97, and preferably has an identical diameter to the second guide section 99. In contrast, the diameter of the first guide section 98 is enlarged.

At the end of the first guide section 98 facing in the direction of the face 96, this radial extension of the valve piston 85 generates a ring surface 101, corresponding to the measuring surface 24 or 64 of the first hydraulic pump unit 1 or second hydraulic pump unit 41 respectively of FIG. 1. Corresponding to the different diameters of the first guide section 98 and the second and third guide sections 100, the recess through the valve sleeve 84 has a radial step 102.

This radial step 102 is axially displaced relative to the ring surface 101, corresponding to the gap between the first guide section 98 and second guide section 99, so that between the ring surface 101 and the radial step 102 a ring-shaped space 103 is formed. This ring-shaped space 103 is connected via radially arranged first bores 104 to a surrounding first groove 105, which is arranged on the outside of the valve sleeve 84. In the case of the first hydraulic pump unit 1, for instance, the first connecting conduit 36 opens into this surrounding first groove 105, as is merely indicated in FIG. 2.

The first guide section 98 and second guide section 99, together with the corresponding sections of the valve sleeve 84, act as a seal. Thus a pressure can be applied to the ring-shaped space, e.g. via the first connecting conduit 36, and generate a hydraulic force on the ring surface 101 in the axial direction, against the force of the first spring 87 and second spring 88.

In the direction of the face 96 of the valve piston 85, a radially tapered section 106 is joined to the second guide section 99, so that in this area of the valve piston 85 again a ring-shaped space, into which two bores 107 which are arranged radially in the valve sleeve 84 open, is formed. These second bores 107 connect the ring-shaped space which is formed around the radially tapered section 106 to a surrounding second groove 108, which is arranged on the circumference of the valve sleeve 84.

The first radially tapered section 106 extends as far as a first control edge 111, which is formed by a renewed radial extension of the valve piston 85. If the valve piston 85 is in its middle position shown in FIG. 2, third bores 109, which are arranged radially in the valve sleeve 84 and open into a surrounding third groove 110, are covered by the first control edge 111, so that between the third bores 109 and the second bores 107 no flow of pressurising medium is possible. Also, in the direction of the face 96, a second control edge 115 is formed on the valve piston 85 by a radial step, to which a second radially tapered section 112 extending as far as the third guide section 100 is joined.

The second control edge 115 is again arranged so that in a middle position of the valve piston 85, a connection from the third bores 109 and to the fourth bores 113, which are arranged in the area of the second radially tapered section 112, is not produced. Thus, in this position of the valve piston 85, a cross-section through which a flow is possible exists from the third bores 109 neither to the second bores 107 nor to the fourth bores 113. Thus, in this equilibrium state, the adjusting pressure in the adjusting pressure chamber 12 is not changed, and the set conveyed volume remains constant.

On the other hand, if the valve piston 85 is moved by a hydraulic force on the ring surface 101, or a greater force which acts on the face 96 of the valve piston 85, against the force of the first spring 87 and second spring 88, the second control edge 115 releases a cross-section through which a flow is possible, and via which the third bores 109 and fourth bores 113 are connected to each other.

A reduction of the forces which act on the valve piston 85 against the spring force results in an opposite movement of the valve piston 85, so that in this case the first control edge 111 releases a cross-section through which a flow is possible, and via which the third bores 109 are connected this time to the second bores 107. This means that, as indicated in FIG. 2 by the reference symbols 17, 20 and 21, the second bores are connected to the tank channel 21, the third bores to the connecting channel 17 and the fourth bores 113 to the joining channel 20.

The bores are preferably arranged in the axial direction as the embodiment of FIG. 2 shows, i.e. so that the first bores 104, via which the working pressure of the other hydraulic pump unit is applied to the ring-shaped space 103 and thus the ring surface 101, are arranged between the spring space 89 and second bores 107. Because the second bores 107 are connected via the tank channel 21 to the tank volume 27 of the hydraulic pump unit, and the spring space 89 is also pressure-free, a leakage path of the pressurising medium out of the ring-shaped space 103 past both the first guide section 98 and the second guide section 99 is given, the escaping leaking fluid being fed in each case via an adjacent pressure-free volume into the tank volume 27. For this purpose, the spring space 89 is also connected to the tank volume 27 via an outflow bore 116.

The invention is not restricted to the described embodiment, and can also be used, for instance, in closed circuits. Also, all described or drawn features can be arbitrarily combined with each other.

The invention claimed is:

1. Total power controller for at least two pumps, which are each connected to a working conduit, and the conveyed volume of which is separately adjustable by an adjusting device, wherein an adjusting pressure which acts on the adjusting device is adjusted by a total power control valve, each said total power control valve having at least one measuring surface on a slidable spool in said valve for imparting control options to said power controller, a working pressure of one said pump being applied directly to the at least one measuring surface of the total power control valve of the other said pump, the slidable spool in the total power control valve of each pump being actable on by a force which is proportional to the power of the therewith associated pump, in the same direction as the hydraulic force which acts on the at least one measuring surface, a ring surface which forms the at least one measuring surface is formed on each respective valve spool; and the ring surface (101) is in such a form that it is arranged in the valve cartridge (81) in an axial direction between two spaces (89) which are connected to a tank volume (27).

2. Total power controller according to claim 1, wherein the total power control valves are in the form of valve cartridges containing said slidable spools.

3. Total power controller according to claim 1, wherein the hydraulic force which acts on the at least one measuring surface and the force which is proportional to the power acting on the valve spool against a spring which is supported on an end face thereof

4. Total power controller according to claim 1, wherein the at least one measuring surface of the total power control valve of one said pump is connected via a connecting conduit to a working conduit of the other said pump to feed the working medium of the other pump.

* * * * *